US009259133B2

(12) United States Patent
Corradini et al.

(10) Patent No.: US 9,259,133 B2
(45) Date of Patent: Feb. 16, 2016

(54) APPARATUS AND METHOD OF USING THE SAME

(71) Applicants: Fabio Corradini, Mira (IT); Cecile Moine, Ludwigshafen (DE); Sara Quaggia, Mira (IT); Ralf Wiedemann, Sao Paulo (BR); Daniel Wong, Nancheng (CN); Jenny Xiao, Nancheng (CN); Eason Xu, Nancheng (CN)

(72) Inventors: Fabio Corradini, Mira (IT); Cecile Moine, Ludwigshafen (DE); Sara Quaggia, Mira (IT); Ralf Wiedemann, Sao Paulo (BR); Daniel Wong, Nancheng (CN); Jenny Xiao, Nancheng (CN); Eason Xu, Nancheng (CN)

(73) Assignee: Reckitt Benckiser N.V., WT Woofddorp (NL)

( * ) Notice: Subject to any disclaimer, the term of this patent is extended or adjusted under 35 U.S.C. 154(b) by 58 days.

(21) Appl. No.: 14/180,925

(22) Filed: Feb. 14, 2014

(65) Prior Publication Data

US 2014/0157527 A1 Jun. 12, 2014

Related U.S. Application Data

(63) Continuation of application No. 14/237,745, filed as application No. PCT/GB2012/052231 on Sep. 11, 2012, now abandoned.

(30) Foreign Application Priority Data

Sep. 13, 2011 (GB) ..... 1115770.8
Dec. 9, 2011 (GB) ..... 1121186.9

(51) Int. Cl.

| | |
|---|---|
| ***A47L 13/26*** | (2006.01) |
| ***A47L 25/08*** | (2006.01) |
| ***B08B 1/00*** | (2006.01) |
| ***B65D 47/20*** | (2006.01) |
| ***B65D 47/42*** | (2006.01) |

(Continued)

(52) U.S. Cl.
CPC ..... *A47L 13/26* (2013.01); *A47L 25/08* (2013.01); *B08B 1/001* (2013.01); *B65D 47/2031* (2013.01); *B65D 47/42* (2013.01); *C11D 11/0017* (2013.01); *C11D 17/046* (2013.01)

(58) Field of Classification Search
None
See application file for complete search history.

(56) References Cited

U.S. PATENT DOCUMENTS 3,229,866 A * 1/1966 Arbitman ..... G01F 11/288 222/453
6,332,729 B1 12/2001 Koreska (Continued)

FOREIGN PATENT DOCUMENTS

EP 0786421 A1 7/1997
EP 1495695 A1 1/2005

(Continued)

OTHER PUBLICATIONS

Notification and Transmittal of the International Search Report and the Written Opinion of the International Searching Authority for PCT/GB2012/052231 dated Nov. 19, 2012.

(Continued)

*Primary Examiner* — Robert C Boyle
(74) *Attorney, Agent, or Firm* — Norris McLaughlin & Marcus PA

(57) ABSTRACT

A cleaning device comprises a cleaning composition container and a dispensing section. The dispensing section is operable to eject an amount of cleaning composition from the cleaning composition container. The dispensing section comprises a domed surface comprising a plurality of projections adapted to work the cleaning composition into an item to be cleaned.

23 Claims, 4 Drawing Sheets

(51) Int. Cl.
*C11D 11/00* (2006.01)
*C11D 17/04* (2006.01)

(56) References Cited

U.S. PATENT DOCUMENTS

| | | | | |
|---|---|---|---|---|
| 7,303,347 | B1 | 12/2007 | Duncan | |
| 2005/0008422 | A1 | 1/2005 | Schwartzman et al. | |
| 2005/0100391 | A1* | 5/2005 | Dobbs et al. | 401/188 R |
| 2006/0015043 | A1 | 1/2006 | Hornsby et al. | |
| 2008/0271272 | A1* | 11/2008 | Righetto | 15/41.1 |

FOREIGN PATENT DOCUMENTS

| | | | |
|---|---|---|---|
| FR | 1244931 | A | 9/1960 |
| GB | 9719691 | | 9/1964 |
| WO | 9705033 | A2 | 2/1997 |
| WO | 2005025372 | A1 | 3/2005 |
| WO | 2006005936 | A1 | 1/2006 |
| WO | 2010028941 | A1 | 3/2010 |

OTHER PUBLICATIONS

International Search Report for PCT/GB2012/052231 dated Nov. 19, 2012.

Written Opinion of the International Searching Authority for PCT/GB2012/052231 dated Nov. 19, 2012.

GB Search Report for GB1115770.8 dated Dec. 21, 2011.

* cited by examiner

APPARATUS AND METHOD OF USING THE SAME

This is a continuation patent application of U.S. Ser. No. 14/237,745, which in turn is an application filed under 35 USC 371 of PCT/GB2012/052231, which claimed priority to GB 1115770.9 filed 13 Sep. 2011 and GB 1121186.9 filed 9 Dec. 2011.

This invention relates to apparatus for cleaning textiles, including carpets, clothing and fabrics and to a method of operating said apparatus.

Compositions exist for cleaning stains, spills and the like from carpets, clothing and other fabrics and textile materials. However, problems arise in the relation to the use of these compositions in that simply spraying the material onto a fabric or carpet and then rubbing the composition into the stain with a cloth does not give consistent results and does not make for best use of the compositions provided. Carpets have a high hydrophobicity that makes it difficult to a cleaning composition to act on fibres; because the cleaning composition is repelled by coatings on the fibres (whether that is the build up of dirt or stain repellant treatments present on the fibres).

It is an object of the present invention to address the above mentioned disadvantages.

According to a first aspect of the present invention there is provided a cleaning device comprises a cleaning composition container and a dispensing section, wherein the dispensing section is operable to eject an amount of cleaning composition from the cleaning composition container, and wherein the dispensing section comprises a domed surface comprising a plurality of projections adapted to work the cleaning composition into an item to be cleaned.

With the use of a domed surface it has been found that much greater flexibility if provided to a user in working a cleaning composition into an article to be cleaned. Said flexibility is particularly noticeable in that the way that the device is held and operated against the surface to be cleaned is now not restricted as with the prior art dispensers. Moreover because of the nature of the domed surface when placed in contact with an item a portion of the domed is in direct contact with the item with the remainder of the domed rising away form the contact point. This is beneficial since when the dome is moved relatively to the item being cleaned the raised area presents a compressive surface with the pressure applied gradually increasing with the approach of the contact point. This has been found to promote bonding of the cleaning composition with/into the article being cleaned.

Additionally it has been found that the domed surface allows a user to focus their application force, when using the device, on a smaller/more concentrated area. This has benefits in giving greater control in targeting areas and also provides for enhanced application force on a smaller/targeted area.

All of these advantages may be achieved without a user having to come into direct contact with the cleaning composition as it is applied to the item being cleaned.

The cleaning device may be a textiles cleaning device, which is preferably adapted for use with textiles materials such as carpets, upholstery, fabrics and/or other materials with a pile.

When cleaning such materials it has been found that with the use of a cleaning device having a domed surface aids deformation of the textile surface being cleaned. It is postulated that this is due to distortion of the textile surface being cleaned (especially when pressure is applied) which it turn leads to better fabric pile penetration by the cleaning fluid.

Additionally it has been found that the device presents a pleasant ergonomic shape for ease of use by a consumer.

Preferably dome comprises a portion of a sphere/ovoid. Alternatively the dome may be a polygonal dome (i.e. a dome that maintain a polygonal shape in their horizontal cross section), e.g. triangle, square, pentagon, hexagon.

Most preferably the dome comprises a "saucer dome", i.e. a low pitched shallow dome which has a circular base and a segmental (less than a semicircle) section. The height of the dome is preferably 15-35%, more preferably 20-30%, and most preferably about 25% of the width of the dome.

Generally the dome comprises a dispensing aperture. Preferably the dispensing aperture is centrally on the dome surface. With such an arrangement it has been found that high controlled directional/locational dispensing may be achieved by a user (which then facilitates more effective stain rubbing/overall treatment). Generally the dispensing aperture comprises a valve. The valve is preferably a "slit-valve" having one or more slits (e.g. a "cross-cut" valve) wherein the slits may be opened at a suitable time to release the cleaning composition. Generally the valve comprises a polymeric material, e.g. such as a silicone.

The projections are preferably of equal length. The projections preferably terminate on substantially the same surface (it is realised that said virtual surface may in itself be domed).

Preferably the number and arrangement of the projections is such that on contact of a portion of a surface of the domed surface with an item a projection is brought into contact with the item. This has been found to greatly aid the cleaning process. Generally the projections extend are arranged in a radial fashion relative to the dispensing aperture. Preferably the projections are arranged in one or more rings. The rings may be staggered relative to one another. The size and nature of the projections in each of the rings may be different, e.g. the projections in the outer ring(s) may be larger than those in the inner ring(s).

The projections may be themselves domed or may be common geometric shapes such as diamonds (elongated truncated pyramids), chevrons, or bristles. It is preferred that the projections comprise a geometric shape which has at least an apex and or an edge (either or both of which may be at least partially rounded). In this way it has been found that in use the friction generated by rubbing the dispensing section against a surface being cleaned is increased leading to more effective fibre penetration. Preferred examples of such projections include truncated pyramids. Such pyramids may have a central upper apex (arranged to contact the surface being cleaned) and a plurality of edges (e.g. 3, 4, 5 or more) dependent therefrom leaning back to the domed surface.

In addition to or an as an alternative to one or more apices/edges the projections may have a secondary structure disposed thereon. [Preferably where present a plurality of secondary structures is present]. The secondary structure may be used to further increase the friction generated by the projection when in use and further to ensure that frictional rubbing occurs with great flexibility in the direction of movement and the angle that the device is held relative to the surface being cleaned. The secondary structure may comprise a smaller form of the base projection or may have a different form. A preferred form of the secondary projection is a rod with a rounded end. Where a plurality of secondary structures are present these may be distributed randomly over the projection or may be distributed strategically, e.g. along the edges (as discussed above). Where present it is not necessarily the case that each projection has one or more secondary structures.

Clearly for all projection embodiments it is a requirement that the projections, whilst aiding stein removal and/or cleaning formulation penetration into the stain/the item being cleaned, will not cause damage to the item being cleaned. Preferably this is achieved by the projection comprising a suitable resilient material (see below).

At least some of the projections may be nozzles, preferably adapted to deliver the cleaning composition through channels therein. Preferably all the projections are nozzles. Preferably there is >1, >3, >5, >7 or >10 nozzles. Ideally these are <15, <13, <11, <9 or <8 nozzles.

Preferably the dispensing section comprises a polymeric material, e.g. such as polypropylene, polyethylene, thermoplastic (TPE) rubbers. Preferably the cleaning composition container comprises a polymeric material, e.g. such as polypropylene, polyethylene.

Such materials are general flexible/resilient. With the use of such a material it has been found that textile fibre penetration is greatly aided.

In one embodiment it has been found that the dome may comprise a multiple portions/sections. In a most preferred arrangement the dome comprises a primary section (preferably to be arranged close to/in abutment with the cleaning composition container) and a secondary section (preferably to be arranged to contact the surface to be/being cleaned). With such and arrangement it has been found that textile fibre penetration is most expedient.

Preferably the domed surface co-operates with a complementary cap for when the device is not in use. Preferably the cap has a section which accommodates at least a portion and more preferably the majority/all of the domed surface. Preferably the cap has a planar surface so that the device may stand on a flat surface, e.g. such as a kitchen cupboard/work surface. Preferably the planar surface is in a plane which is parallel to the portion of the cap that accommodates the domed surface. In this way it has been found that the device is always "ready-foruse", i.e. the contents of the container section generally tend to be located at or near the dispensing section, without a user having to shake (or otherwise manipulate) the device before use.

The cleaning device may be a handheld cleaning device. The cleaning device may be adapted to be held in two hands.

The cleaning device may incorporate a handle section. The handle section may contain the cleaning composition container. The cleaning composition container may be accessible by a door section. Alternatively, the cleaning composition container may be secured to an exterior of the handle section.

The handle section may be moveable relative to the dispensing section, which may be by means of a pivotable joint between the two.

The dispensing section may be adapted for reciprocal movement, preferably with respect to the cleaning composition container. The reciprocal movement may be a circular or back and forth movement, which may be an oscillating movement, preferably adapted to oscillate the projections relative to the article to be cleaned. The cleaning device preferably includes a switch operable to selectively activate or deactivate the reciprocal movement of the dispensing section.

The cleaning device may include a switch operable to selectively activate or deactivate a supply of the cleaning composition to the dispensing section.

The cleaning composition container may be an aerosol container. The cleaning composition container may be a pouch, preferably having at least one flexible wall. The pouch preferably has an output valve. The pouch may contain a cleaning composition in a gel formulation. The pouch may be adapted to eject an amount of cleaning composition therefrom on application of pressure by a user; said pressure may result from a user gripping the pouch.

According to a second aspect of the invention there is provided a cleaning composition container as described in relation to the first aspect, the cleaning composition container being adapted for use with a dispensing section as described in the first aspect.

The dispensing section may have a handle section attached thereto. Said handle section may be adapted to receive the cleaning composition container therein.

According to a third aspect of the present invention there is provided a method of cleaning a textiles material comprising placing a dispensing section (comprising a domed surface) of a cleaning device on a textiles material to be cleaned, dispensing an amount of cleaning composition onto or into the material to be cleaned, and moving the dispensing section relative to the textiles material, to thereby work the cleaning composition into the textiles material.

The reference to textiles material should be taken to include materials such as those having a pile (including rugs of any sort), carpets, upholstery and fabrics, including clothing fabrics and materials. Preferably the textile material is an item of clothing or a carpet.

The cleaning composition may be dispensed into a pile of the textiles material.

The dispense may occur with the device being positioned such that it abuts against the item being cleaned, for intimate/accurate release of the composition onto the area being treated. Alternatively, for addition user flexibility, the dispense may occur with the device being held a distance away from the item being cleaned. In the latter case the holding distance may be between 5-50 cm, e.g. about 15 cm.

Typically 2-20 ml, e.g. 2-10 ml of cleaning composition is dispensed in a cleaning operation.

The cleaning composition may be dispensed from the projections, preferably substantially from ends thereof (ideally by means of channels that are in fluid communication with the cleaning composition container). The channels connecting the exits of the nozzles to the cleaning composition container preferably meet together at a manifold. Thereby, ideally a lower numbers (preferably one) of channels connect from the cleaning composition container to the channels connected to the nozzles through the manifold.

The cleaning composition may be dispensed by pushing the cleaning composition container towards the dispensing section or by squeezing the cleaning composition container. However, it will be understood that the container may be gripped by a user, applying a lower level of force, without causing any dispense.

The cleaning composition dispense may include operation of a switch.

The projections may be moved by means of oscillating the dispensing section relative to a handle section of the cleaning device.

The method allows a dispense operation and a movement operation which are separate. Namely dispense of the cleaning composition and/or the movement operation can occur independently. This allows a user to exercise judgement in the balance of physical effort and the correct amount of cleaning composition when treating an item.

The dispense operation and the movement operation may be chronologically separated. Namely there may be a time delay between the dispense of the cleaning formulation ad the working of same into the surface being cleaned. This could be for one or more of variety of reasons including allowing (chemical/solvation) operation of one or more actives in the cleaning formulation on a stain. Such delay is typically quite short and is generally in the range of 10 seconds to 10 minutes, e.g. about 5 minutes.

According to a fourth aspect of the present invention there is provided a method of cleaning comprising using a cleaning composition container as described in the second aspect or a cleaning device of the first aspect for the method of the fourth aspect.

All of the features described herein may be combined with any of the above aspects, in any combination.

For a better understanding of the invention, and to show how embodiments of the same may be carried into effect, reference will now be made, by way of example, to the accompanying diagrammatic drawings in which.

Figure 1:
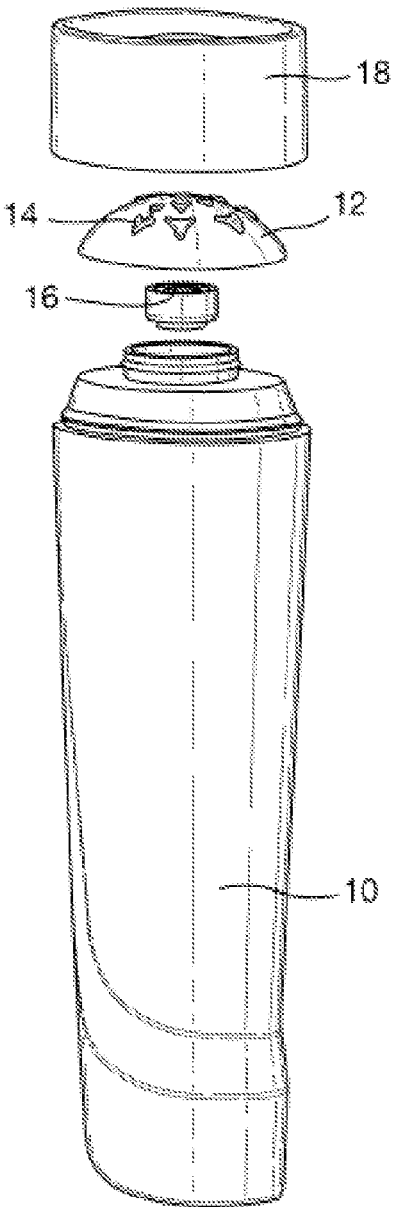
FIG. 1 is a perspective view of an exploded textiles cleaning device.
Figure 4:
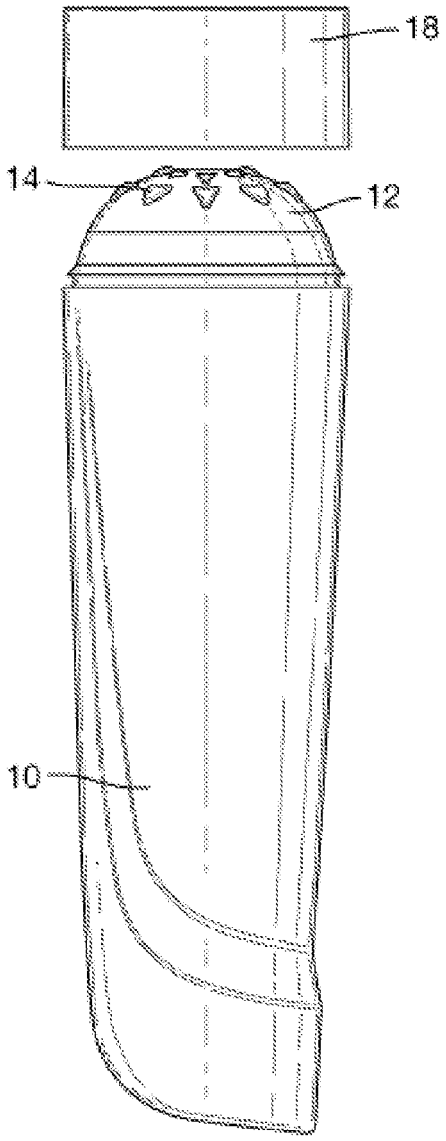
FIG. 4 is a perspective view of the partially exploded textiles cleaning device shown in FIG. 1.
Figure 2:
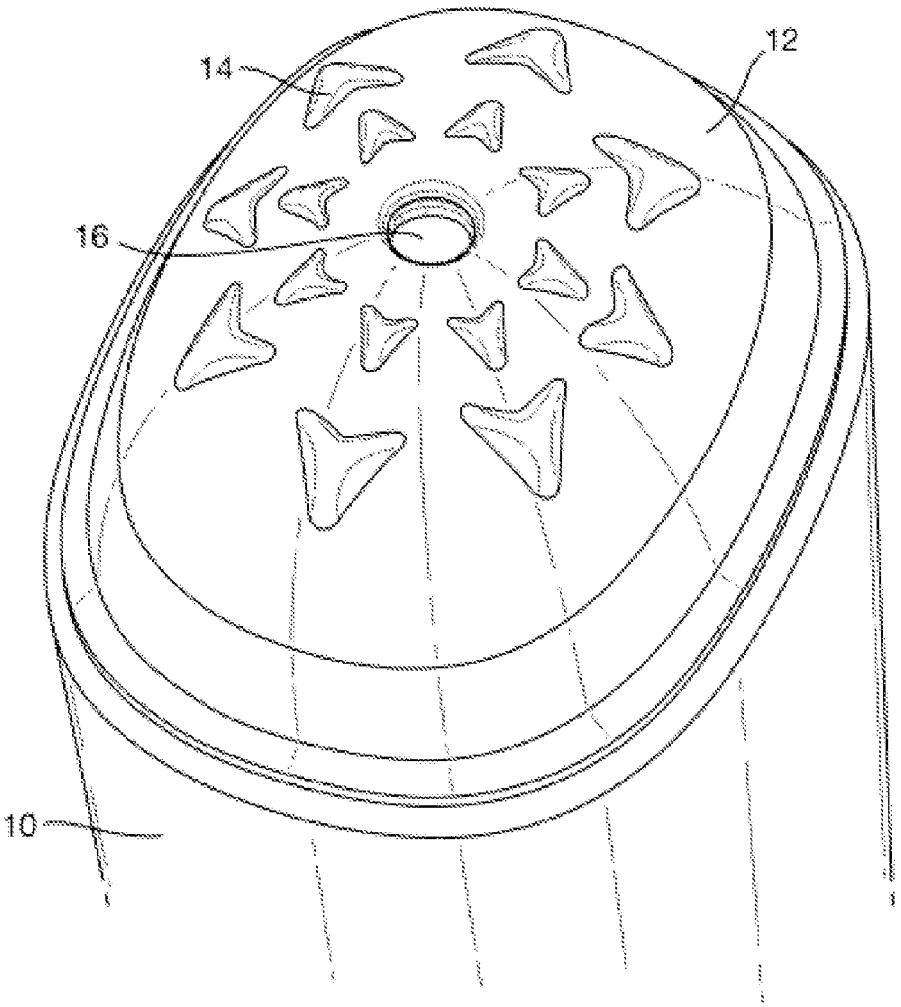
FIG. 2 is a plan of the cleaning device shown in FIG. 1.
Figure 3:
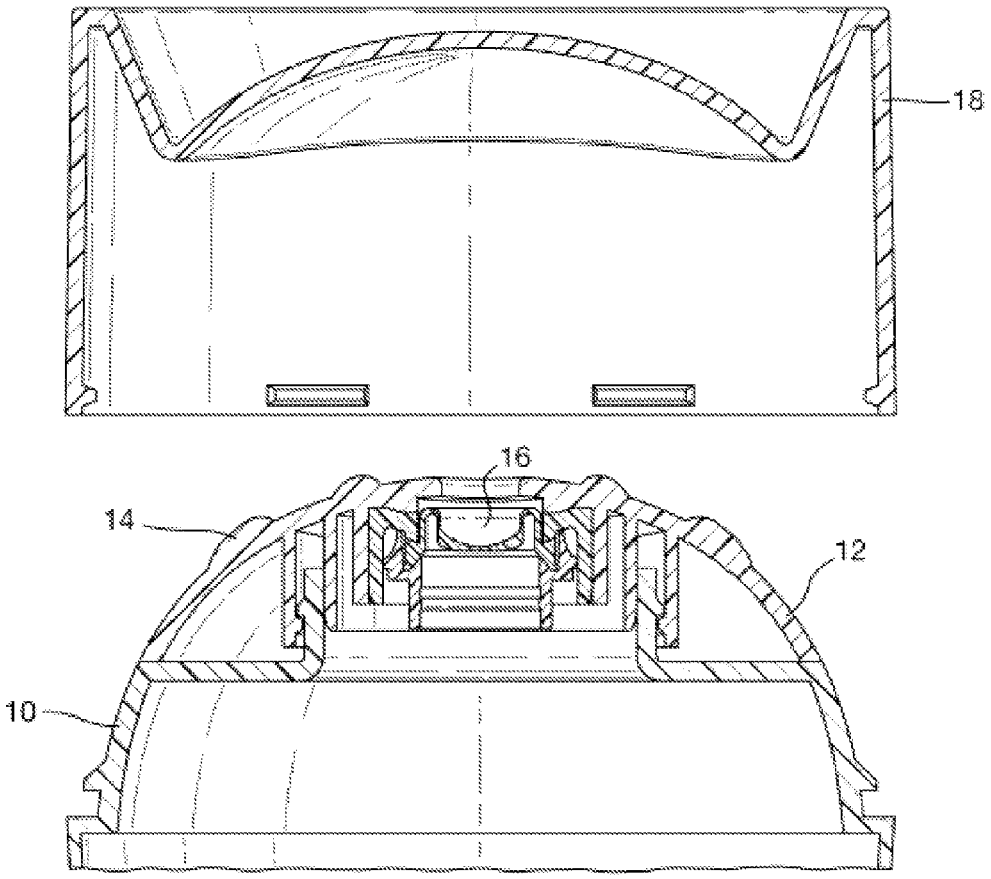
FIG. 3 is a perspective and cross-sectional side views of the cleaning device shown in FIG. 1.

The Figures show a cleaning device comprising a cleaning composition container 10 and a dispensing head 12. The dispensing head 12 comprises a domed surface having a plurality of projections 14 mounted thereon. The dispensing head 12 incorporates a dispensing valve 16 (in the form of a slit valve) through which cleaning composition from the cleaning composition container 10 is dispensed. The dispensing head 12 has an associated complementary lid 18.

In use, a user grasps the cleaning composition container 10 and pushes it towards an item to be cleaned (not shown) which is generally a fabric based article such as a carpet/rug or an item of clothing or other household item such as sheet/tablecloth/upholstery material. The projections 14 penetrate slightly into the pile of the fabric based article. When the user exerts sufficient pressure an amount of cleaning composition from the cleaning composition container 10 is ejected from the dispensing valve 16 into the pile of the fabric based article.

The composition envisaged is the applicant's Vanish™ formulation.

This cleaning device has significant advantages in that the cleaning composition is delivered into/beneath the surface of the pile of the fabric based article. Thus, excellent penetration of the cleaning product is achieved. Also, stains and dirt are not driven downwards into the fabric based article. Instead since it is applied beneath the surface of the fabric based article the waste material is allowed to rise upwards and carry the stain with it for subsequent removal. Also, at the same time movement of the cleaning device by the user causes the nozzles to loosen and capture or dissolve a stain that is being cleaned.

Additional benefits from the penetration of the projections 14 into the textile or fabric material to be cleaned is that cleaning within the fabric is effected, rather than just on the surface thereof. This action is further facilitated by the domed nature of the dispensing head 12 which allows for greater ease and flexibility of use for a consumer. The formulation of the cleaning composition allows the cleaning of stains such as red wine, pet stains, coffee and tomato sauce.

Figure 5:
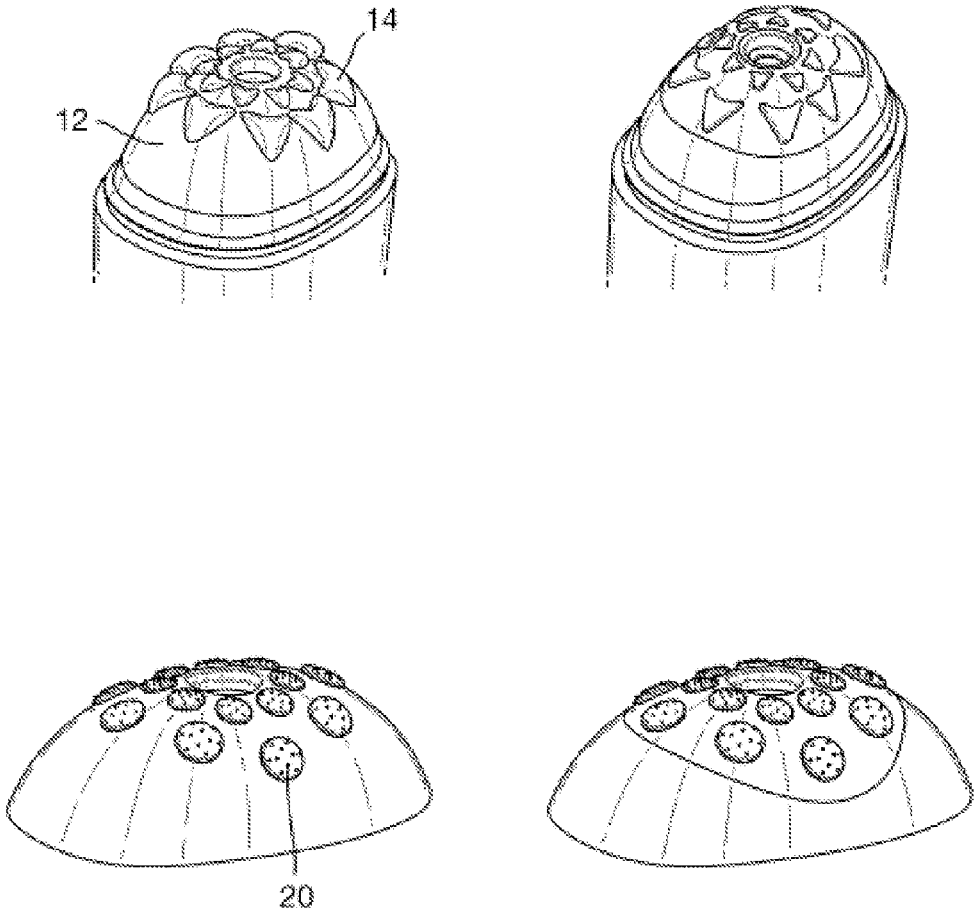
FIG. 5 is a perspective view of alternative dispensing sections of the textiles cleaning device shown in FIG. 1.

As shown in FIG. 5 the projections 14 may have a different arrangement/size/shape from that shown in FIG. 1. Additionally the projections 14 may have secondary structures 20 (in the form of rods) disposed thereon. The secondary structure may be used to further increase the friction generated by the projection when in use and further to ensure that frictional rubbing occurs with great flexibility in the direction of movement and the angle that the device is held relative to the surface being cleaned.

The device of the invention has the benefit of ejecting material from a hand held cleaning device into a textile material or fabric. The cleaning composition is ejected close to the surface of the item being cleaned or even inside the item being cleaned in the case of materials with piles such as carpets or knitted items. A user can work the cleaning composition into the item being cleaned for better penetration thereof compared to cleaning compositions that are simply applied to the surface of an item being cleaned.

The cleaning composition used may be any of those suitable for cleaning stains in carpets or fabrics etc. The products may be in the form of a gel, a liquid, a powder (which may be compressed), or any other suitable type that can be dispensed.

A superwetting agent can be added to overcome the problem associated with the high repellancy of carpet to water. This is primarily caused from two sources, the first being the amount of soiling which can accumulate on carpets and, secondly, the prevalence of stain repelling treatments, which are increasingly commonly applied to carpets either during manufacture or by the consumer. In this invention a super wetting agent is a special surfactant added at levels of below 10% w/w of the composition, preferably below 9, 8, 7, 6 or 5% w/w, of the composition, that can, combined with any other surfactant present in the composition, is able to lower the surface tension of the final diluted liquid cleaning formulation to values below 28 mN/m, when 10 g is dissolved in 4 liters of water.

Preferably a product is used having from 50 and 500 ml of liquid carpet cleaning composition per device, ideally from 100 to 250 ml.

Builders

The cleaning composition comprises at least one builder active or a combination of builders from 0.1 to 90% w/w, preferably from 0.1 to 50% w/w. Preferably the builder is soluble or miscible with the cleaning composition.

Suitable carboxylate compounds are used and include the monomeric polycarboxylates, or their acid forms and polymeric polycarboxylic acids or their salts. Polymeric polylcarboxylic acids are preferred for the reasons given above, in terms of protecting the water-soluble polymer.

The carboxylate builder can be monomeric or polymeric in type, monomeric polycarboxylates are generally preferred for reasons of cost and performance.

Suitable and preferred polymeric polycarboxylic acids are iminosuccinic acid or polyaspartic acid, mixtures thereof or their metal/amino salts. Examples of these polymers are Baypure CX 100/34 and Baypure DS 100/40 supplied from Bayer.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy)diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivates such as the carboxymethloxysuccinates described in GB-A-1,379,241, lactoxysuccinates described in GB-A-1,389,732, and aminosuccinates described in NL-A-7,205,873, and the oxypolycarboxylate materials such as 2-oxa-1,1,3-propane tricarboxylates described in GB-A-1,387,447.

Polycarboxylate containing four carboxy groups include oxydisuccinates disclosed in GB-A-1,261,829, 1,1,2,2-ethane tetracarboxylates, 1,1,3,3-propane tetracarboxylates and 1,1,2,3-propane tetracarobyxlates. Polycarboxylates containing sulfo suibstituents include the sulfosuccinate derivatives disclosed in GB-A-1,398,421, GB-A-1,398,422 and U.S. Pat. No. 3,936,448, and the sulfonated pyrolsed citrates described in GB-A-1,439,000.

Alicylic and heterocyclic polycarboxylates include cyclopentane-cis,cis,cis-tetracarboxylates, cyclopentadienide pentacarboxylates, 2,3,4,5,6-hexane-hexacarboxylates and carboxymethyl derivates of polyhydric alcohols such as sorbitol, mannitol and xylitol. Aromatic polycarboxylates include mellitic acid, pyromellitic acid and the phthalic acid derivatives disclosed in GB-A-1,425,343.

Of the above, the preferred polycarboxylates are hydroxycarboxylates containing up to three carboxy groups per molecule, more particularly citrates.

More preferred are the polymer builders, i.e. polymeric polycarboxylic acid, which are homo-polymers, copolymers and multiple polymers of acrylic, flourinated acrylic, sulfonated styrene, maleic anhydride, metacrylic, isobutylene, styrene and ester monomers. Examples of these polymers are Acusol supplied from Rohm & Haas, Syntran supplied from Interpolymer and Versa and Alcosperse series supplied from Alco Chemical, a National Starch & Chemical Company.

Suitable builders are bicarbonates, sesquicarbonates, borates, phosphates, phosphonates, and mixtures of any of thereof.

Water-soluble phosphonate and phosphate builders are useful for this invention. Examples of phosphate buiders are the alkali metal tripolyphosphates, sodium potassium and ammonium pyrophosphate, sodium and potassium and ammonium pyrophosphate, sodium and potassium orthophosphate sodium polymeta/phosphate in which the degree of polymerisation ranges from 6 to 21, and salts of phytic acid.

Specific examples of water-soluble phosphate builders are the alkali metal tripolyphosphates, sodium potassium and ammonium pyrophosphate, sodium and potassium and ammonium pyrophosphate, sodium and potassium orthophosphate, sodium polymeta/phosphate in which the degree of polymerization ranges from 6 to 21, and salts of phytic acid.

Examples of bicarbonate and carbonate builders are the alkaline earth and the alkali metal carbonates, including sodium carbonate and sesqui-carbonate and mixtures thereof. Other examples of carbonate type builders are the metal carboxy glycine and metal glycine carbonate.

Surfactants

Examples of surfactants considered in this invention are either anionic, non-ionic or cationic. Preferred total levels of surfactant are from 0.1 to 70% w/w, ideally from 1 to 30% wt and preferably between 5 to 20% w/w.

Examples of non-ionic surfactant are described in the formula $RO(CH_2CH_2O)nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Examples of other non-ionic surfactants include higher aliphatic primary alcohols containing about twelve to about 16 carbon atoms which are condensed with about three to thirteen moles of ethylene oxide.

Other examples of non-ionic surfactants include primary alcohol ethoxylates (available under the Neodol tradename from Shell Co.), such as $C_{11}$ alkanol condensed with 9 moles of ethylene oxide (Neodol 1-9), $C_{12-13}$ alkanol condensed with 6.5 moles ethylene oxide (Neodol 23-6.5), $C_{12-13}$ alkanol with 9 moles of ethylene oxide (Neodol 23-9), $C_{1-15}$ alkanol condensed with 7 or 3 moles ethylene oxide (Neodol 25-7 or Neodol 25-3), $C_{14-15}$ alkanol condensed with 13 moles ethylene oxide (Neodol 45-13), $C_{9-11}$ linear ethoxylated alcohol, averaging 2.5 moles of ethylene oxide per mole of alcohol (Neodol 91-2.5), and the like.

Other examples of non-ionic surfactants suitable for use in the present invention include ethylene oxide condensate products of secondary aliphatic alcohols containing 11 to 18 carbon atoms in a straight or branched chain configuration condensed with 5 to 30 moles of ethylene oxide. Examples of commercially available non-ionic detergents of the foregoing type are $C_{11-15}$ secondary alkanol condensed with either 9 moles of ethylene oxide (Tergitol 15-S-9) or 12 moles of ethylene oxide (Tergitol 15-S-12) marketed by Union Carbide, a subsidiary of Dow Chemical.

Octylphenoxy polyethoxyethanol type non-ionic surfactants, for example, Triton X-100, as well as amine oxides can also be used as a non-ionic surfactant in the present invention.

Other examples of linear primary alcohol ethoxylates are available under the Tomadol tradename such as, for example, Tomadol 1-7, a $C_{11}$ linear primary alcohol ethoxylate with 7 moles EO; Tomadol 25-7, a $C_{12}$-$C_{15}$ linear primary alcohol ethoxylate with 7 moles EO; Tomadol 45-7, a $C_{14-15}$ linear primary alcohol ethoxylate with 7 moles EO; and Tomadol 91-6, a $C_9$-$C_{11}$ linear alcohol ethoxylate with 6 moles EO.

Amine oxides can also be used as the non-ionic surfactant of the present invention. Exemplary useful amine oxide compounds may be defined as one or more of the following of the four general classes:

(1) Alkyl di(lower alkyl)amine oxides in which the alkyl group has about 6-24, and preferably 8-18 carbon atoms, and can be straight or branched chain, saturated or unsaturated. The lower alkyl groups include between 1 and 7 carbon atoms, but preferably each include 1-3 carbon atoms. Examples include octyl dimethyl amine oxide, lauryl dimethyl amine oxide, myristyl dimethyl amine oxide, and those in which the alkyl group is a mixture of different amine oxides, such as dimethyl cocoamine oxide, dimethyl (hydrogenated tallow) amine oxide, and myristyl/palmityl dimethyl amine oxide;

(2) Alkyl di(hydroxy lower alkyl)amine oxides in which the alkyl group has about 6-22, and preferably 8-18 carbon atoms, and can be straight or branched chain, saturated or unsaturated. Examples include bis-(2-hydroxyethyl)cocoamine oxide, bis(2-hydroxyethyl)tallowamine oxide; and bis-(2-hydroxyethyl)stearylamine oxide;

(3) Alkylamidopropyl di(lower alkyl)amine oxides in which the alkyl group has about 10-20, and preferably 12-16 carbon atoms, and can be straight or branched chain, saturated or unsaturated. Examples include cocoamidopropyl dimethyl amine oxide and tallowamidopropyl dimethyl amine oxide; and (4) Alkylmorpholine oxides in which the alkyl group has about 10-20, and preferably 12-16 carbon atoms, and can be straight or branched chain, saturated or unsaturated.

Useful anionic surfactant are frequently provided in a salt form, such as alkali metal salts, ammonium salts, amine salts, amino alcohol salts or magnesium salts. Contemplated as useful are one or more sulfate or sulfonate compounds including: alkyl sulfates, alkyl ether sulfates, alkylamidoether sulfates, alkyl benzene sulfates, alkyl benzene sulfonates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl carboxylates, alkyl phosphates, alkyl ether phosphates, acyl sarconsinates, acyl isethionates, and N-acyl taurates. Generally, the alkyl or acyl radical in these various compounds comprise a carbon chain containing 12 to 20 carbon atoms.

Other examples of anionic surfactants are also alkyl naphthalene sulfonate anionic surfactants of the formula:

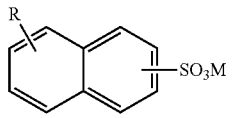

wherein R is a straight chain or branched alkyl chain having from about 1 to about 25 carbon atoms, saturated or unsaturated, and the longest linear portion of the alkyl chain is 15 carbon atoms or less on the average, M is a cation which makes the compound water soluble especially an alkali metal such as sodium or magnesium, ammonium or substituted ammonium cation.

Other examples are alkyl sarcosinate, sulfosuccinate and alkyl sulfate anionic surfactants of the formula

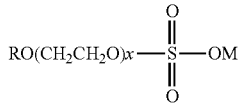

wherein R is a straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium or magnesium, ammonium or substituted ammonium cation, and x is from 0 to about 4. Most preferred are the non-ethoxylated $C_{12-15}$ primary and secondary alkyl sulfates, especially sodium lauryl sulfate.

Most desirably, the anionic surfactant according to constituent is selected to be of a type that dries to a friable powder. This facilitates their removal from carpets and carpet fibres, such as by brushing or vacuuming.

The cationic surfactants of the invention are quaternary ammonium salts which may be characterised by the general structural formula:

$[CN1R2R3R4]^+$ wherein R1, R2, R3 and R4 are independently selected from alkyl, aryl or alkylaryl substituent of from 1 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl and arylalkyl. The remaining substituents on the nitrogen atoms other than the above mentioned alkyl substituents are hydrocarbons usually containing no more than 12 carbon atoms. The substituents R1, R2, R3 and R4 may be straight-chained or may be branched, but are preferably straight-chained, and may include one or more amide, ether or ester linkages.

The counterion X— are selected from halogens anions, saccharinate, alkyl and alkyl benzene sulfate, sulfonate and fatty acid.

Super Wetting Agents

The super wetting agents of this invention are present at levels of from 0.1 to 10% w/w, ideally 0.5 to 5% w/w, and are selected from silicone glycol copolymers and fluorosurfactants.

The silicone glycol copolymers are described by the following formula:

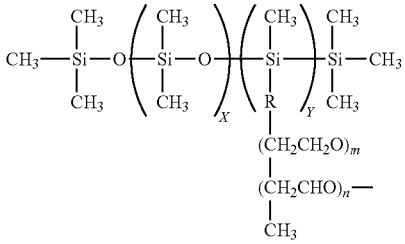

Where X, Y, m and n are whole number ranging from 0 to 25. X is preferably between 0 to 10 and Y, m and n between 0 to 5. R and R' are straight chain or branched alkyl chain having from about 1 to 25 carbon atoms, saturated or unsaturated, and the longest linear portion of the alkyl chain is on average 15 carbon atoms or less.

The fluorinated surfactant is described in the following formulae:

$F(CF_2)_n$—N(CH3)(CH2)3-$(CH_2CH_3O)_xOSO_2M$ $F(CF_2)_n$—N(CH3)(CH2)3-$(CH_2CH_3O)_xOSO_2M$ $CF_3(CF_2CF_2)_n(CFCF)_n$—$(CH_2CH_2O)_x$—$OPO_3M_2$

Wherein n, m and x are integers having a value from 0 to 15; preferred values are between 1 and 12. M is a cation which is capable of making the compound water-soluble, especially an alkali metal such as sodium or magnesium or an ammonium or substituted ammonium cation.

The super wetting agents described are able to lower the surface tension in water at values below 25 mN/m at a concentration less than 0.1% w/v.

Antifoaming agents are an important addition to carpet cleaning compositions of this invention, they are used at a level between 0.01 and 5% w/w. A very high foam level may not allow the carpet cleaning machine to function properly. Antifoaming agents are also considered important components of this invention. Examples are polydimethylsiloxanes, preferably in combination with hydrophobic silica.

Solvents:

Organic solvents should be water-miscible or water emulsionable. The organic solvent is found at levels of 0.01 to 60% w/v, more preferably between 0.1 to 30% w/w. The organic solvent constituent of the inventive compositions include one or more alcohols, glycols, acetates, ether acetates, glycol ethers and hydrocarbons. Exemplary alcohols useful in the compositions of the invention include $C_2$-$C_8$ primary and secondary alcohols which may be straight chained or branched. Exemplary alcohols include pentanol and hexanol. Exemplary glycol ethers include those glycol ethers having the general structure Ra-O-Rb-OH, wherein Ra is an alkoxy of 1 to 20 carbon atoms, or aryloxy of at least 6 carbon atoms, and Rb is an ether condensate of propylene glycol and/or ethylene glycol having from 1 to 10 glycol monomer units. Preferred are glycol ethers having 1 to 5 glycol monomer units.

By way of further non-limiting example specific organic constituents include propylene glycol methyl ether, dipropylene glycol methyl ether, tripropylene glycol methyl ether, propylene glycol n-propyl ether, ethylene glycol n-butyl ether, diethylene glycol n-butyl ether, diethylene glycol methyl ether, propylene glycol, ethylene glycol, isopropanol, ethanol, methanol, diethylene glycol monoethyl ether acetate and particularly useful is, propylene glycol phenyl ether, ethylene glycol hexyl ether, diethylene glycol hexyl ether. Examples of hydrocarbons solvents are linear and branched, saturated and unsaturated carbon chain with a number of carbon atoms from $C_4$-$C_{40}$, preferably from $C_6$-$C_{22}$.

A thickening agent or gelling agent may be used. Suitable thickeners are polyacrylate polymers such as those sold under the trade mark CARBOPOL, or the trade mark ACUSOL by Rohm and Hass Company. Other suitable thickeners are xanthan gums.

The thickener, if present, is generally present in an amount of from 0.2 to 4 wt %, especially 0.2 to 2 wt %.

Preferred examples of cleaning formulation s ate below:—

| Component | % | |
|---|---|---|
| Deionised water | To 100 | To 100 |
| Alkylethoxylate C12-14 7EO | 9.5 | 10.6 |
| Alkylethoxylate C12-16 3EO | 3.0 | 3.0 |
| Sulfonic Acid 96% | 3.8 | 4.0 |
| NaOH 48% | 0.4 | 0.5 |
| TEA | 1.0 | 1.0 |
| Calcium Chloride | 0.05 | 0.05 |
| Preservative | 0.025 | 0.025 |
| Enzyme | 1.4 | 1.4 |
| Perfume | 0.2 | 0.2 |

The invention claimed is:

1. A cleaning device which comprises a cleaning composition container and a dispensing section, wherein:

the dispensing section comprises a dispensing head having a domed surface comprising a plurality of projections extending therefrom which are adapted to work the cleaning composition into an item to be cleaned, at least one of the plurality of projections have a secondary structure disposed thereon and wherein the dispensing section operates to eject an amount of cleaning composition from the cleaning composition container.

2. A cleaning device according to in claim 1, wherein the said cleaning device is a textiles cleaning device.

3. A cleaning device according to in claim 1, wherein the shape of the dispensing head comprises a portion of a sphere.

4. A cleaning device according to in claim 1, wherein the shape of the dispensing head comprises a polygonal dome.

5. A cleaning device according to in claim 1, wherein the shape of the dispensing head comprises a saucer dome.

6. A cleaning device according to in claim 1, wherein the dispensing head comprises a dispensing aperture in fluid communication with a valve.

7. A cleaning device according to claim 6, in which the projections extend radially from the dispensing aperture.

8. A cleaning device according to claim 6, in which the projections occupy a portion of the dome between the dispensing aperture and a rim of the dome.

9. A cleaning device according to claim 6, in which the valve is a slit valve.

10. A cleaning device according to claim 1, in which the cleaning device is a handheld cleaning device.

11. A cleaning device according to claim 1, in which the cleaning device incorporates a handle section.

12. A claim device according to claim 11, in which the handle section contains the cleaning composition container.

13. A cleaning device according to claim 1, in which the dispensing section is adapted for an oscillating movement.

14. A cleaning device according to claim 1, which includes a switch operable to selectively activate or deactivate a supply of the cleaning composition to the dispensing section.

15. A cleaning device according to claim 1, in which the cleaning composition container is an aerosol container.

16. A cleaning device according to claim 1, in which the cleaning composition container is a pouch.

17. A cleaning composition container adapted for use with a dispensing section of the cleaning device according to claim 1.

18. A method of cleaning a textiles material which comprises the steps of:

placing the dispensing section of a cleaning device according to claim 1 onto or into a textiles material to be cleaned, dispensing an amount of cleaning composition onto or into the material to be cleaned from the cleaning device, and moving the dispensing section relative to the textiles material to thereby work the cleaning composition into the textiles material.

19. A method according to claim 18, in which the cleaning composition is dispensed into a pile of the textiles material.

20. A method as claimed in claim 18, in which the cleaning composition is dispensed from a dispensing aperture and/or from one or more of the projections.

21. A method according to claim 20, wherein the cleaning composition is dispensed by pushing the cleaning composition container towards the dispensing section or is dispensed by squeezing the cleaning composition container, to expel the cleaning composition out from the cleaning device.

22. A cleaning device which comprises a cleaning composition container containing a non-pressurized cleaning composition therein, and a dispensing section which comprises a dispensing head having a domed surface comprising a plurality of projections extending therefrom which are adapted to work the cleaning composition into an item to be cleaned, and at least one dispensing aperture and/or at least one nozzle present in at least one of the projections, wherein the dispensing operates to eject an amount of cleaning composition from the cleaning composition container via a slit valve and outwardly through the at least one dispensing aperture and/or at least one nozzle.

23. A cleaning device according to claim 22, wherein at least one of the plurality of projections has a secondary structure disposed thereon.

* * * * *